US005515824A

United States Patent [19]

Yamagishi et al.

[11] Patent Number: 5,515,824

[45] Date of Patent: May 14, 1996

[54] METHOD AND APPARATUS FOR CONTROLLING FUEL SUPPLY SHUT OFF OF AN INTERNAL COMBUSTION ENGINE

[75] Inventors: Yoichiro Yamagishi; Yoshikazu Tanaka, both of Atsugi, Japan

[73] Assignee: Unisia Jecs Corporation, Atsugi, Japan

[21] Appl. No.: 211,318

[22] PCT Filed: Aug. 5, 1993

[86] PCT No.: PCT/JP93/01104

§ 371 Date: Apr. 1, 1994

§ 102(e) Date: Apr. 1, 1994

[87] PCT Pub. No.: WO93/01104

PCT Pub. Date: Aug. 5, 1993

[30] Foreign Application Priority Data

Aug. 5, 1992 [JP] Japan ..... 4-208719

[51] Int. Cl.[6] ..... F02D 41/12

[52] U.S. Cl. ..... 123/325; 123/481; 123/493

[58] Field of Search ..... 123/325, 481, 123/493

[56] References Cited

U.S. PATENT DOCUMENTS 4,674,458 6/1987 Mori ..... 123/333

4,694,796 9/1987 Mori ..... 123/325

5,186,080 2/1993 Simon, Jr. et al. ..... 123/325 X

FOREIGN PATENT DOCUMENTS 63-179150 7/1988 Japan .

63-141854 9/1988 Japan .

2-29854 7/1990 Japan .

*Primary Examiner*—Tony M. Argenbright

*Attorney, Agent, or Firm*—Foley & Lardner

[57] ABSTRACT

The invention involves stopping the operation of an internal combustion engine, when actual vehicle deceleration is detected after a vehicle deceleration operation. Alternatively, under conditions wherein it is possible to shut off fuel supply at the time of the deceleration operation, the invention involves stopping the operation of the engine by shutting off the fuel supply to some cylinders, and then shutting off the fuel supply to all cylinders when actual vehicle deceleration is detected. Since the fuel supply to the engine is timed to be shut off when the vehicle is decelerated, the speed is reduced smoothly without an accompanying large torque change. Thus, vehicle ride comfort and fuel consumption can be improved.

6 Claims, 6 Drawing Sheets

METHOD AND APPARATUS FOR CONTROLLING FUEL SUPPLY SHUT OFF OF AN INTERNAL COMBUSTION ENGINE

TECHNICAL FIELD

The present invention relates to a method and apparatus for controlling the shut off of a fuel supply to an automotive internal combustion engine in a predetermined deceleration condition.

BACKGROUND ART

In general with automotive internal combustion engines (see for example the disclosure of Japanese Unexamined Patent Publication No. 63-179150) a mechanism is provided for shutting off the fuel supply in a predetermined deceleration condition.

With initial designs, the fuel supply is timed to be shut off immediately after satisfying conditions such as, the rate of reduction in throttle valve opening exceeds a predetermined value, and the engine rotational speed at the start of the deceleration operation exceeds a predetermined value.

In reality however, a delay occurs from the start of the deceleration operation until the engine output torque is reduced and the reduction in torque transmitted to the axle through the transmission to give an actual reduction in the vehicle speed. Therefore, if the fuel supply to all of the cylinders is shut off immediately after the deceleration operation, then this will give a large deceleration resistance while the travelling inertia of the vehicle is still large, resulting in a large torque shock with deterioration in comfortable ride.

It has thus been considered to shut off the fuel supply after a predetermined time lapse from commencement of the deceleration operation. Also, since an excessive torque change results when the fuel supply is shut off to all cylinders simultaneously, then a general stepwise fuel supply shut off control has been proposed to give stepwise reduction in the torque. This involves first shutting off the fuel supply to some cylinders after the deceleration operation and then shutting off the fuel supply to the remaining cylinders. With this arrangement however, the timing for the fuel supply shut off to some or all of the cylinders is set according to an elapsed time after the deceleration operation.

With the system wherein the timing to reduce the torque is merely set according to an elapsed time after the deceleration operation, it is not possible to shut off the fuel supply with good timing. This is because deceleration conditions differ due to such factors as the engine operating conditions at the time of or after the deceleration operation, and the travelling road surface conditions. This results in problems such as excessive torque fluctuations which detract from comfortable ride, and the negation of any sufficient improvement in fuel consumption due to the delay in supply shut off.

In view of the above heretofore encountered problems, it is a first object of the present invention to provide a method for controlling the fuel supply shut off of an internal combustion engine which sufficiently improves fuel consumption and comfortable ride, by controlling the fuel supply shut off on the basis of actual vehicle deceleration conditions.

Moreover, it is a second object of the present invention to provide an apparatus for controlling the fuel supply shut off of an internal combustion engine which sufficiently improves fuel consumption and comfortable ride, by controlling the fuel supply shut off on the basis of actual vehicle deceleration conditions.

DISCLOSURE OF THE INVENTION

In order to achieve the above objectives, the method and apparatus according to the present invention for controlling a fuel supply shut off of an internal combustion engine involves the method and apparatus as indicated by the full lines in FIG. 1 for controlling a shut off of a fuel supply to an automotive internal combustion engine at the time of a predetermined deceleration condition, and comprises: a vehicle deceleration detection step or device for detecting a vehicle deceleration condition which occurs with a delay after a deceleration operation of the driver, and a fuel supply shut off step or device for shutting off of the fuel supply to the internal combustion engine when a vehicle deceleration is detected by the vehicle deceleration detection step or device.

With such a construction, after the driver carries out a deceleration operation, a delay occurs from the start of the deceleration operation until the engine output torque is reduced and the reduction in torque transmitted to the axle through the transmission to give an actual vehicle deceleration.

The vehicle deceleration detection step or device detects the actual vehicle deceleration by detecting an axle torque change, or in the case of a vehicle fitted with an automatic transmission incorporating a torque converter, by detecting the ratio or difference between input and output rotational speeds of the torque converter.

Since the fuel supply to the engine is timed to be shut off by the fuel supply shut off step or device when the vehicle is decelerated, then vehicle deceleration can be carried out smoothly without an accompanying large torque change.

Furthermore, as shown by the dotted line in FIG. 1, the construction may comprise, the beforementioned deceleration detection step or device, a fuel supply shut off judgement step or device for judging if fuel supply shut off is possible, and the beforementioned fuel supply shut off step or device for shutting off the fuel supply to some of the cylinders when it is judged by the fuel supply shut off judgement step or device that fuel supply shut off is possible, and for shutting off of the fuel supply to the remaining cylinders when a vehicle deceleration is detected by said vehicle deceleration detection step or device.

With a device incorporating such a fuel supply shut off judgement step or device, when initially judged that fuel supply shut off is possible, the fuel supply to some of the cylinders is shut off. Then when a vehicle deceleration is detected, the fuel supply to the remaining cylinders is shut off. As a result, the fuel supply shut off is carried out in a stepwise manner so that torque changes become smaller and the vehicle can be decelerated more smoothly.

BEST MODE FOR CARRYING OUT THE INVENTION

Figure 1:
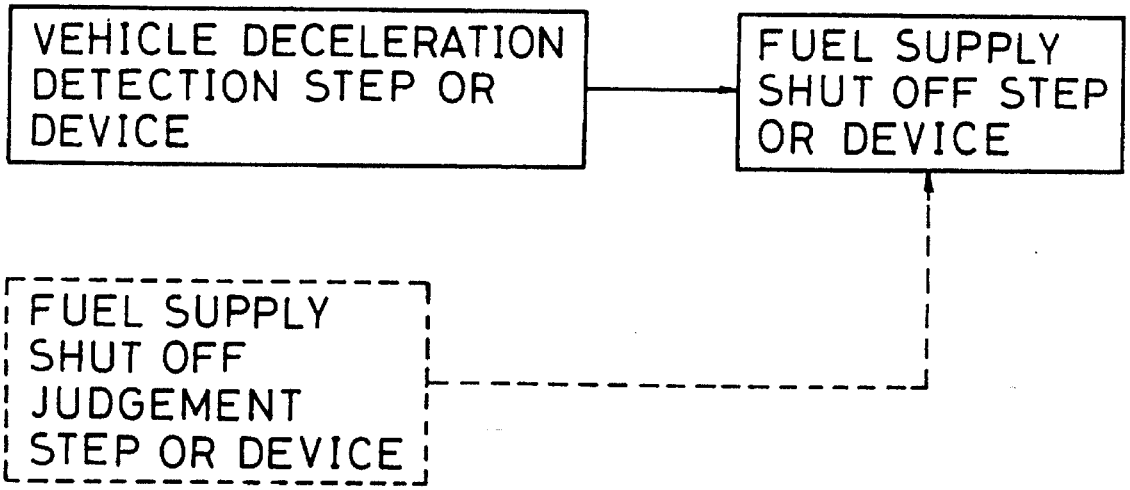
FIG. 1 is a block diagram showing the structure and functions of the present invention.
Figure 2:
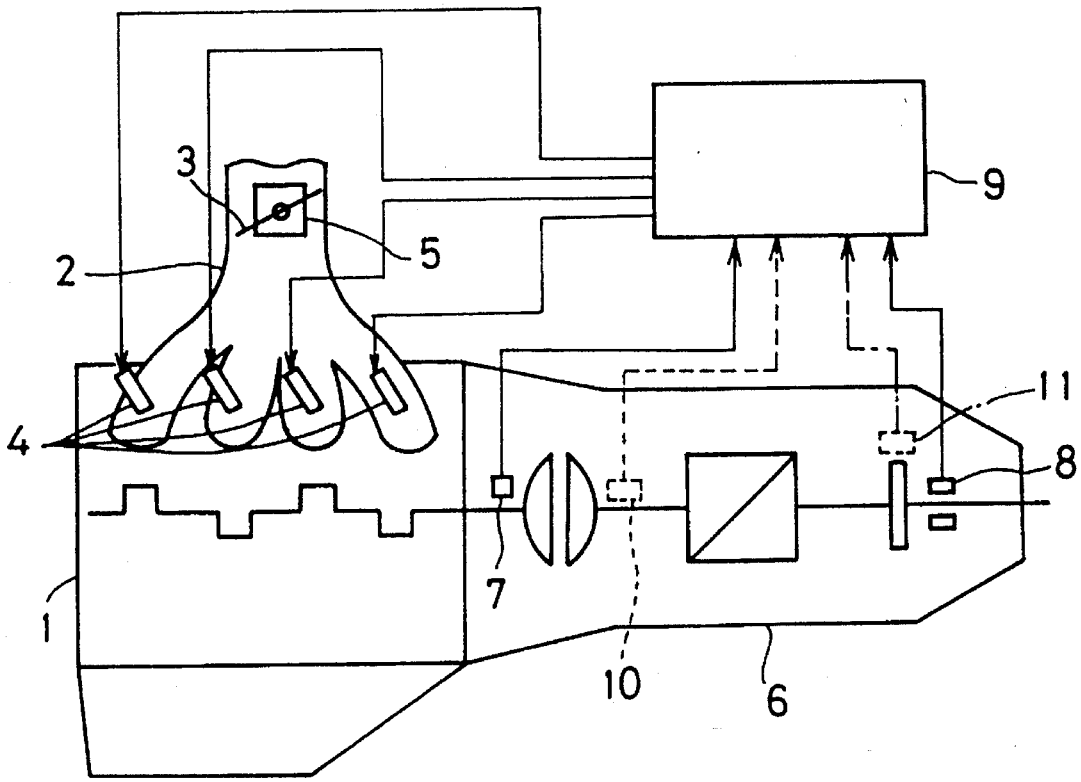
FIG. 2 is a schematic diagram illustrating a system layout of a first embodiment according to the present invention.

As follows is a description of embodiments of the present invention based on the drawings. In FIG. 2 which shows a hardware layout, an intake passage 2 of an internal combustion engine 1 is fitted with a throttle valve 3 and respective fuel injection valves 4 for each of the cylinders. Also provided is a throttle sensor 5 connected to the throttle valve 3 for detecting the valve opening thereof (this hardware layout is common to embodiments of the present invention).

The internal combustion engine 1 is connected to an automatic transmission 6 which incorporates a torque converter. An engine rotational speed detection sensor 7 for detecting the engine rotational speed is fitted to the input shaft of the torque converter, while a torque sensor 8 for detecting the torque of the output shaft of the automatic transmission 6 is fitted to the output shaft.

Detection signals from the respective sensors are input to a control circuit 9 which incorporates a micro computer. The control circuit 9 controls the fuel injection amount from the fuel injection valves 4 in accordance with the operating conditions detected on the basis of the various signals.

Fuel supply shut off according to the present invention is carried out with satisfaction of fuel shut off conditions such as; the rate of closing the throttle valve 3 in a deceleration condition exceeds a predetermined value, and the engine rotational speed at commencement of the deceleration operation exceeds a predetermined value.

Figure 3:
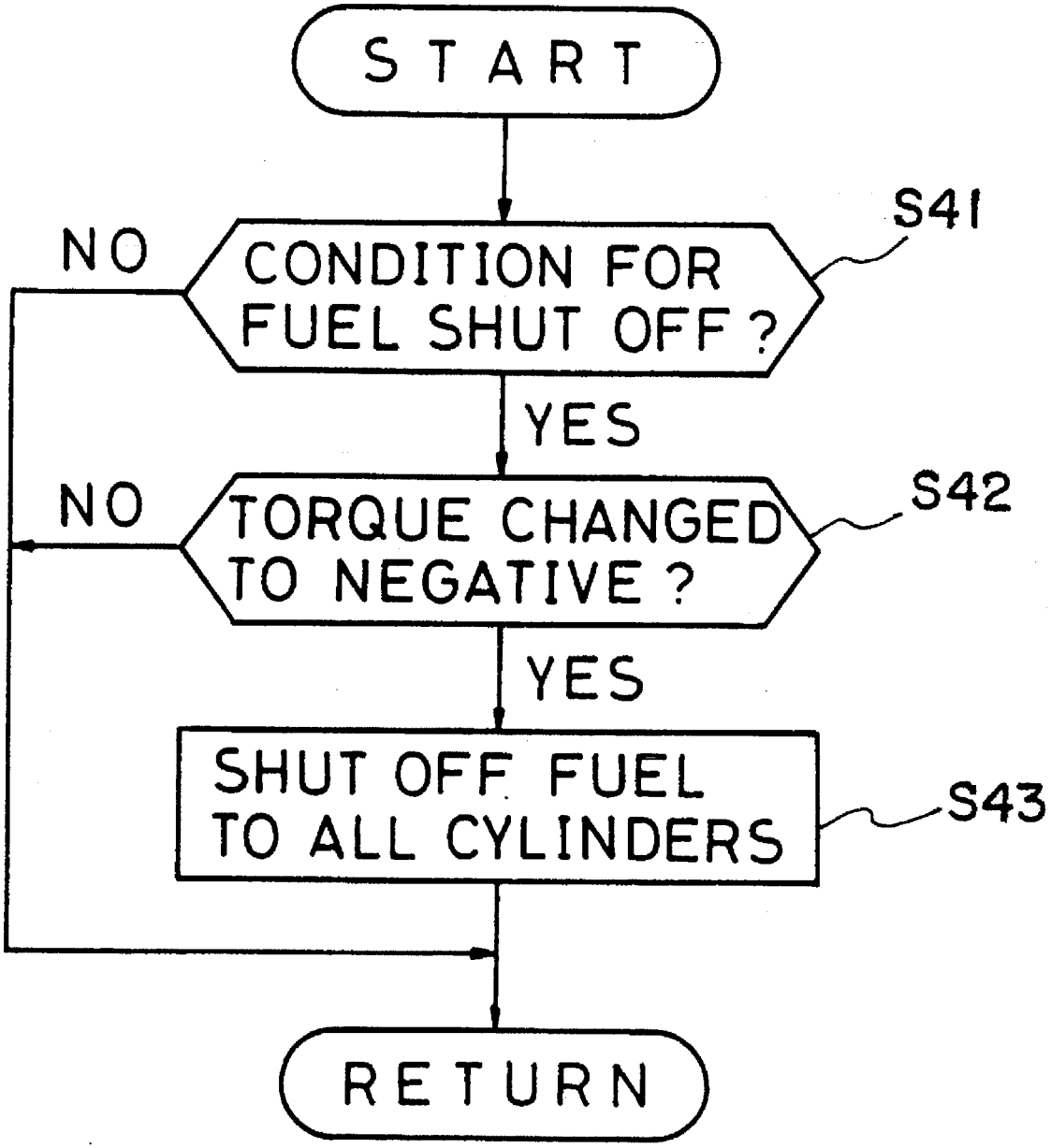
FIG. 3 is a flow chart for a fuel supply shut off control of the first embodiment.

As follows is a description of a fuel supply shut off control of a first embodiment in accordance with the flow chart of FIG. 3.

In step 41 ("step" denoted by S in the figures) it is judged if conditions for fuel supply shut off have occurred. That is, if the rate of closing the throttle valve 3 detected by the throttle sensor 5 exceeds a predetermined value, with the engine rotational speed N detected by the engine rotational speed sensor 7 above a predetermined value.

In step 42, it is judged if the direction of the automatic transmission output shaft torque detected by the torque sensor 8 (the direction of driving force transmission from the engine to the automatic transmission), which is assumed positive at the time of non-deceleration, has changed to negative. That is, if vehicle deceleration has commenced due to rotational drive from the automatic transmission 6 of the engine 1 being a load.

When vehicle deceleration is detected with a torque change to the negative direction, control proceeds to step 43 and the fuel supply to all cylinders of the engine 1 is shut off.

The fuel supply is subsequently reopened under conditions such as, when the engine rotational speed falls below a second predetermined value due to the deceleration. Description of the reopening control is omitted.

With such a fuel supply shut off control, the fuel supply is shut off after the deceleration operation, when an actual vehicle deceleration is detected. Consequently, a good deceleration performance which satisfies comfortable ride requirements is obtained, and economy is also satisfied due to the avoidance of wasteful delay in shutting off the fuel supply.

In this embodiment, the vehicle deceleration detection step or device comprises the torque sensor 8 and the function of step 42, while the fuel supply shut off step or device comprises the function of step 43.

Figure 4:
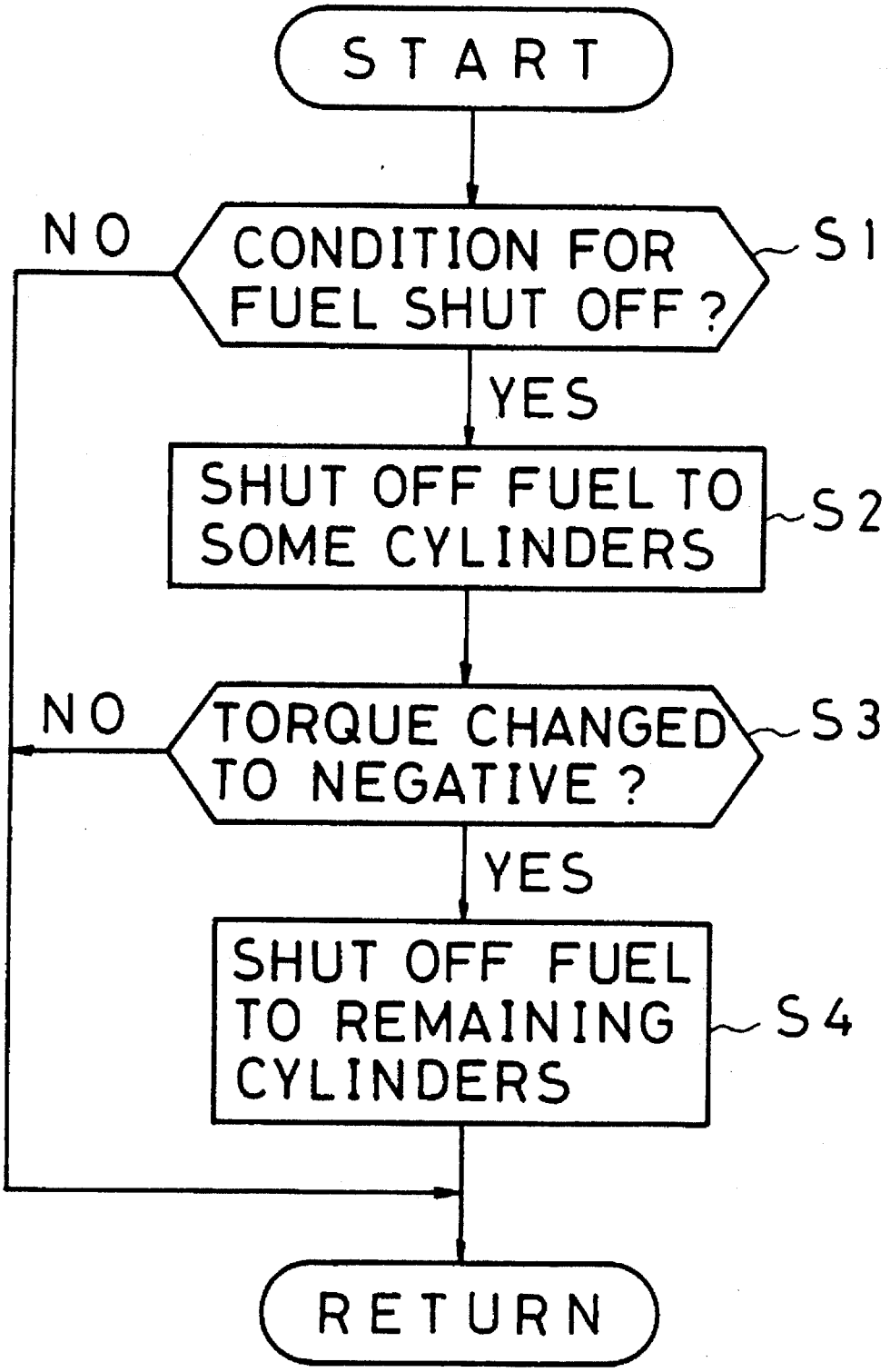
FIG. 4 is a flow chart for a fuel supply shut off control of a second embodiment.

FIG. 4 shows a fuel supply shut off control according to a second embodiment.

In step 1, as with the beforementioned step 41, it is judged if conditions for fuel supply shut off have occurred.

If so, control proceeds to step 2 to shut off the fuel supply to some of the cylinders of the engine 1.

In step 3, as with the beforementioned step 42, it is judged if vehicle deceleration has commenced.

When judged that vehicle deceleration has commenced, control proceeds to step 4 and the fuel supply to all cylinders of the engine 1 is shut off.

With such a fuel supply shut off control, the deceleration effect is increased by a certain amount by shutting off the fuel supply to some of the cylinders immediately after the occurrence of fuel shut off conditions. Then the fuel supply to the remaining cylinders is timed to be shut off with commencement of actual vehicle deceleration, without influence from conditions at the time of and after the deceleration operation. The speed reducing force can therefore be made to act at an optimum effective timing without an accompanying large torque change. Consequently a good deceleration performance which adequately satisfies comfortable ride requirements is obtained, and economy is also satisfied due to the avoidance of wasteful delay in shutting off the fuel supply.

Furthermore, with the second embodiment, the fuel supply shut off judgement step or device comprises the function of step 1, the vehicle deceleration detection step or device comprises the torque sensor 8 and the function of step 3, and the fuel supply shut off step or device comprises the functions of step 2, and step 4.

Figure 5:
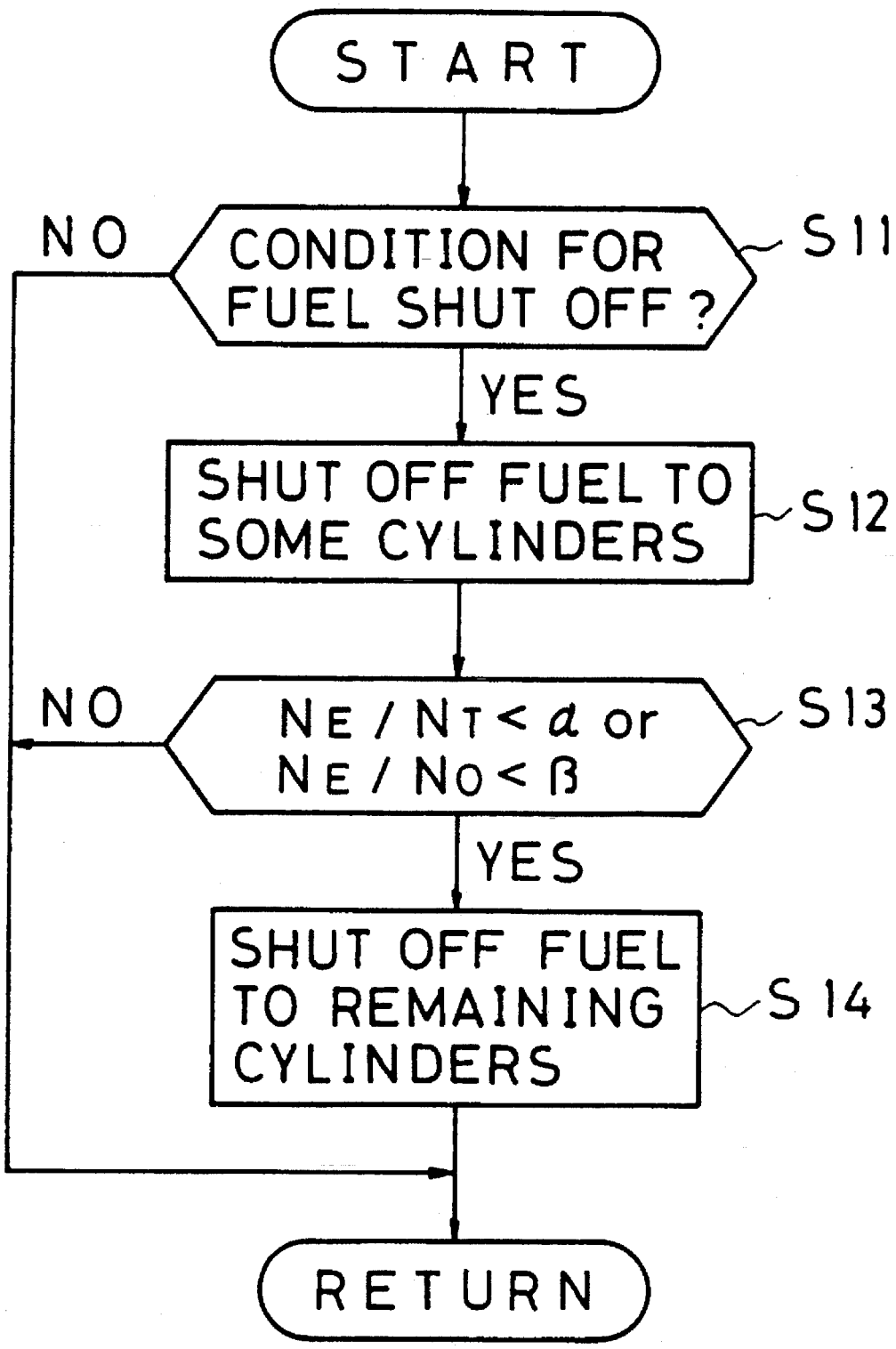
FIG. 5 is a flow chart for a fuel supply shut off control of third and fourth embodiments.

In third and fourth embodiments, in place of the torque sensor 8 there is provided a turbine rotational speed sensor 10, as shown by the dotted line in FIG. 2, for detecting the rotational speed of the turbine output shaft of the torque converter, or a vehicle speed sensor 11 as shown by the chain line in FIG. 2, for detecting the rotational speed of the output shaft of the automatic transmission 6. As shown by the flow chart in FIG. 5 for the fuel supply shut off control, in step 13 it is judged that the vehicle is decelerated when the ratio of the engine rotational speed $N_E$ to the turbine output shaft rotational speed $N_T$ or to the transmission output shaft rotational speed $N_O$ falls below a predetermined value (that is, a value which is added a predetermined amount to one or a value at non-deceleration time determined by the gear ratio of the transmission).

That is to say, the third and fourth embodiments utilize the fact that due to slip in the torque converter at the time of vehicle deceleration, the rotational speed of the output shaft is greater than that of the engine.

With the third and fourth embodiments, the fuel supply shut off judgement step or device comprises the function of step 11, the vehicle deceleration detection step or device comprises the engine rotational speed sensor 7, the turbine rotational speed sensor 10 or the vehicle speed sensor 11, and the function of step 13, while the fuel supply shut off step or device comprises the functions of step 12 and step 14.

Figure 6:
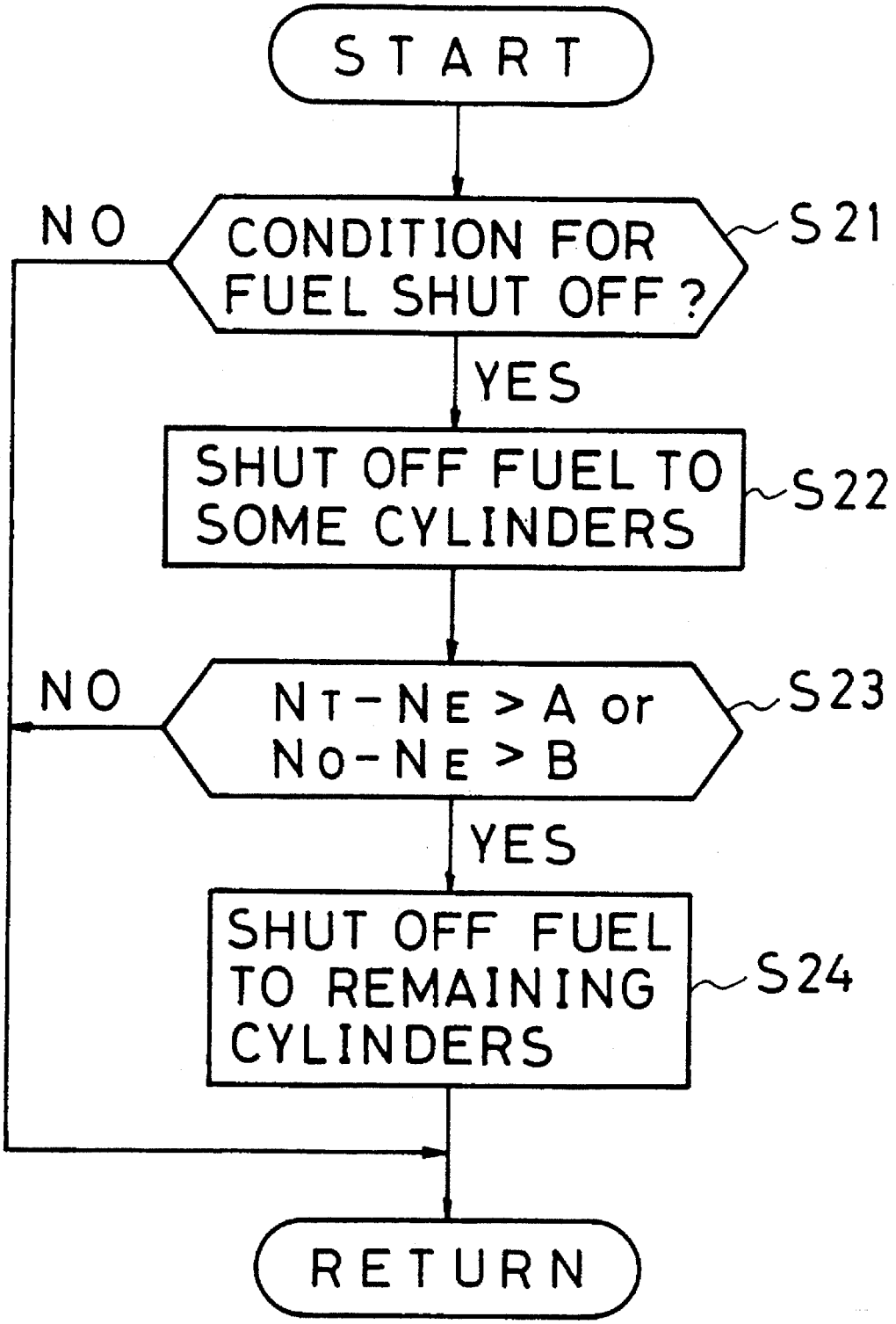
FIG. 6 is a flow chart for a fuel supply shut off control of fifth and sixth embodiments.

The hardware in the fifth and sixth embodiments is similar to that of the third and fourth embodiments. However, as shown by the flow chart of FIG. 6 for the fuel supply shut off control, in step 23 it is judged that the vehicle is decelerated when the engine rotational speed $N_E$ has fallen below the turbine output shaft rotational speed $N_T$ or the transmission output shaft rotational speed $N_O$ by a predetermined value (differing according to the change gear ratio in the case of $N_O$). A different method is used to that of the third and fourth embodiments, but with similar considerations.

With the fifth and sixth embodiments, the fuel supply shut off judgement step or device comprises the function of step 21, the vehicle deceleration detection step or device comprises the engine rotational speed sensor 7, the turbine rotational speed sensor 10 or the vehicle speed sensor 11, and the function of step 23, while the fuel supply shut off step or device comprises the functions of step 22 and step 24.

The effects obtained by the third through sixth embodiments are similar to those of the second embodiment since only the methods of detecting vehicle deceleration are different.

Figure 7:
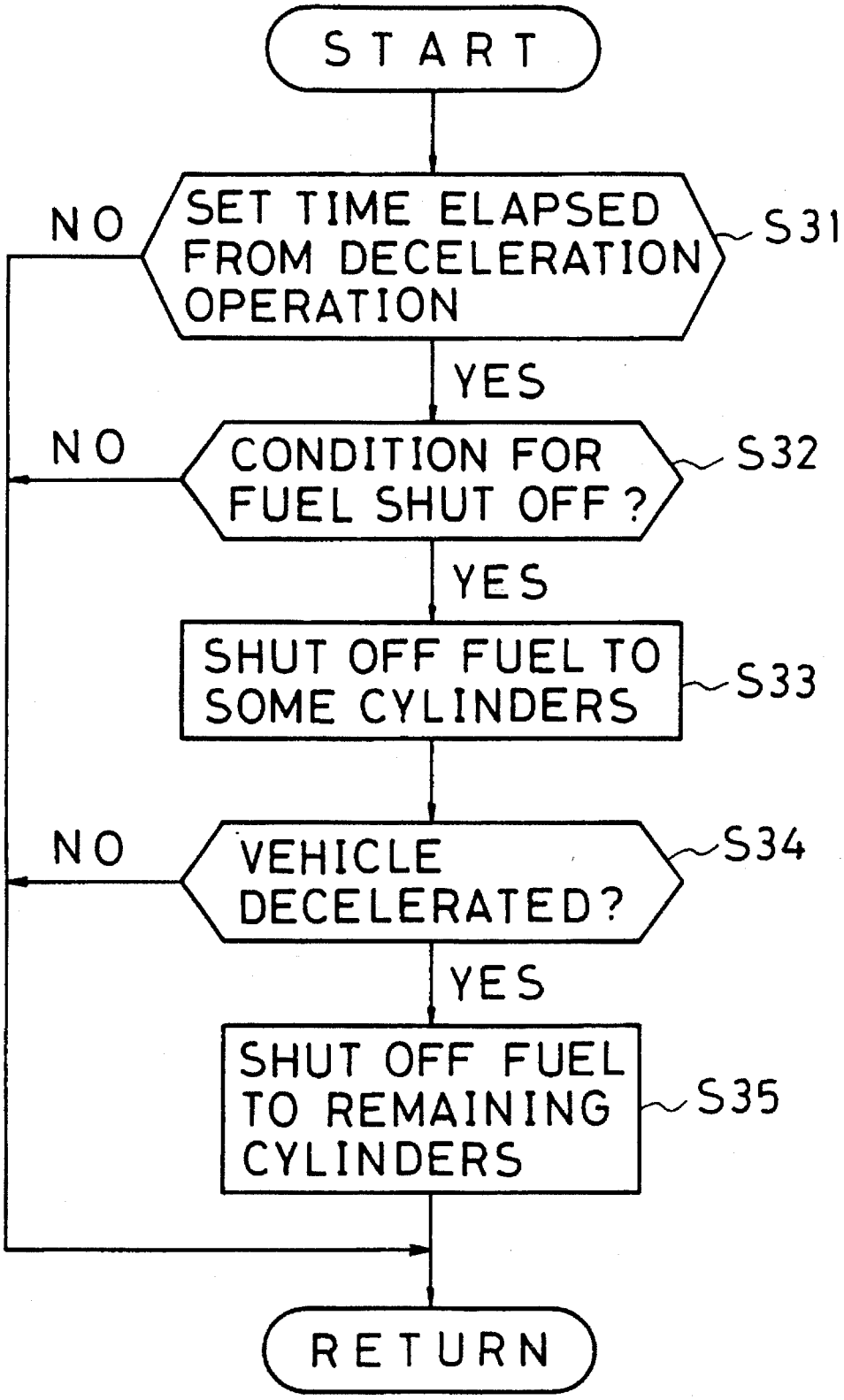
FIG. 7 is a flow chart for a fuel supply shut off control of a seventh embodiment.

FIG. 7 shows a flow chart for a fuel supply shut off control of a seventh embodiment.

With the seventh embodiment, in step 31, it is judged if a set period has elapsed from commencement of a deceleration operation determined for example by the rate of reducing the opening of the throttle valve 3. After the elapse of the set period, then in step 32 it is judged if conditions for fuel supply shut off have occurred. If so, control proceeds to step 33 to shut off the fuel supply to some of the cylinders. Then in step 34, vehicle deceleration is judged. When deceleration is judged, the fuel supply to the remaining cylinders is shut off. The judgement of vehicle deceleration in step 34 may involve any of the methods illustrated in the previous embodiments.

With the seventh embodiment, there is a first torque reduction due to a reduction in fuel supply quantity at the time of the deceleration operation. Then there is a second torque reduction due to the fuel supply shut off to some of the cylinders after a set period. Finally there is a third torque reduction due to the fuel supply shut off to the remaining cylinders when vehicle deceleration is detected. Since the reduction in torque is carried out in three stages, there is a gentle change in torque, with the final fuel supply shut off to all of the cylinders being effected at an optimum timing. Hence, a good deceleration performance is obtained with an improvement in comfortable ride and fuel consumption.

In the seventh embodiment, the fuel supply shut off judgement step of device comprises the function of step 32, the vehicle deceleration detection step or device comprises the function of step 34 and the various sensors used in judging the in vehicle deceleration in step 34, while the fuel supply shut off step or device comprises the functions of step 33, and step 35.

With the present invention as described above, the construction is such that the fuel supply to the engine is timed to be shut off after the vehicle deceleration operation, at the time of an actual vehicle deceleration. Consequently the deceleration function can be made to work effectively without an accompanying large change in torque, so that deceleration performance can be maximized with an improvement in comfortable ride and fuel consumption.

INDUSTRIAL APPLICABILITY

The above described method and apparatus for controlling the fuel supply shut off to an internal combustion engine according to the present invention enables an improvement in vehicle ride comfort and economy. Thus, the method and apparatus according to the present invention not only give but contributes to the automotive industry.

The claims defining the invention are as follows:

1. A method for controlling a fuel supply shut off of an internal combustion engine at the time of a predetermined deceleration said method comprising the steps of:

a vehicle deceleration detection step for detecting a vehicle deceleration condition which occurs with a delay after a deceleration operation of a driver, and a fuel supply shut off step for shutting off of the fuel supply to the internal combustion engine when a vehicle deceleration is detected by said vehicle deceleration detection step, wherein said vehicle is fitted with an automatic transmission, and said vehicle deceleration step judges a deceleration condition when a direction of torque in an output shaft of said automatic transmission changes to a direction opposite to that occurring at a time of non-deceleration.

2. A method for controlling a fuel supply shut off of an internal combustion engine at the time of a predetermined deceleration, said method comprising the steps of:

a vehicle deceleration detection step for detecting a vehicle deceleration condition which occurs with a delay after a deceleration operation of a driver, and a fuel supply shut off step for shutting off of the fuel supply to the internal combustion engine when a vehicle deceleration is detected by said vehicle deceleration detection step, wherein said vehicle is fitted with an automatic transmission incorporating a torque converter, and said vehicle deceleration detection step detects a deceleration condition on the basis of the magnitude of a rotational speed No of an input shaft of said torque converter and the magnitude of a rotational speed Ne of an output shaft of said automatic transmission.

3. A method for controlling a fuel supply shut off of an internal combustion engine at the time of a predetermined deceleration, said method comprising: a vehicle deceleration detection step for detecting a vehicle deceleration condition which occurs with a delay after a deceleration operation of a driver, a fuel supply shut off judgement step for judging if fuel supply shut off is possible, and a fuel supply shut off step for shutting off the fuel supply to some of the cylinders when it is judged by the fuel supply shut off judgement step that fuel supply shut off is possible, and for shutting off of the fuel supply to the remaining cylinders when a vehicle deceleration is detected by said vehicle deceleration detection step.

4. An apparatus for controlling a fuel supply shut off of an internal combustion engine at the time of a predetermined deceleration, said apparatus comprising:

vehicle deceleration detection means for detecting a vehicle deceleration condition which occurs with a delay after a deceleration operation of a driver, and fuel supply, shut off means for shutting off of the fuel supply to the internal combustion engine when a vehicle deceleration is detected by said vehicle deceleration detection means, wherein said vehicle is fitted with an automatic transmission, and said vehicle deceleration detection means judges a deceleration condition when a direction of torque in an output shaft of said automatic transmission changes to a direction opposite to that occurring at a time of non-deceleration.

5. An apparatus for controlling a fuel supply shut off of an internal combustion engine at the time of a predetermined deceleration said apparatus comprising:

vehicle deceleration detection means for detecting a vehicle decelerating condition which occurs with a delay after a deceleration operation of a driver, and fuel supply shut off means for shutting off of the fuel supply to the internal combustion engine when a vehicle deceleration is detected by said vehicle deceleration detection means, wherein said vehicle is fitted with an automatic transmission incorporating a torque converter, and said vehicle deceleration detection means detects a deceleration condition on the basis of the magnitude of a rotational speed No of an input shaft of said torque converter and the magnitude of a rotational speed Ne of an output shaft of said automatic transmission.

6. An apparatus for controlling a fuel supply shut off of an internal combustion engine at the time of a predetermined deceleration, said apparatus comprising: vehicle deceleration detection means for detecting a vehicle deceleration condition which occurs with a delay after a deceleration operation of a driver, fuel supply shut off judgement means for judging if fuel supply shut off is possible, and fuel supply shut off means for shutting off the fuel supply to some of the cylinders when it is judged by the fuel supply shut off judgement means that fuel supply shut off is possible, and for shutting off of the fuel supply to the remaining cylinders when a vehicle deceleration is detected by said vehicle deceleration detection means.

* * * * *